US011267668B2

(12) United States Patent
Mochizuki

(10) Patent No.: US 11,267,668 B2
(45) Date of Patent: Mar. 8, 2022

(54) PAPER CONVEYANCE DEVICE CONVEYING PAPER, IMAGE READING DEVICE, AND IMAGE FORMING APPARATUS

(71) Applicant: KYOCERA Document Solutions Inc., Osaka (JP)

(72) Inventor: Masayuki Mochizuki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 188 days.

(21) Appl. No.: 16/870,923

(22) Filed: May 9, 2020

(65) Prior Publication Data

US 2020/0361733 A1 Nov. 19, 2020

(30) Foreign Application Priority Data

May 17, 2019 (JP) ..... JP2019-094120

(51) Int. Cl.
*B65H 7/06* (2006.01)
*B65H 9/16* (2006.01)
*B65H 5/06* (2006.01)

(52) U.S. Cl.
CPC ..... *B65H 9/166* (2013.01); *B65H 5/06* (2013.01); *B65H 7/06* (2013.01)

(58) Field of Classification Search
CPC . B65H 9/166; B65H 5/06; B65H 7/06; B65H 2511/51; B65H 2511/515; B65H 2511/528; B65H 2513/50; B65H 2511/414
See application file for complete search history.

(56) References Cited

U.S. PATENT DOCUMENTS

| | | | | |
|---|---|---|---|---|
| 7,532,854 | B2 * | 5/2009 | Shin | B65H 29/68 399/405 |
| 7,665,731 | B2 * | 2/2010 | Shingai | B65H 7/02 271/265.02 |
| 8,011,651 | B2 * | 9/2011 | Morita | B65H 5/062 271/10.03 |
| 9,340,383 | B2 * | 5/2016 | Kowase | B65H 7/18 |
| 11,198,571 | B2 * | 12/2021 | Ota | B65H 3/0684 |
| 2010/0301550 | A1 * | 12/2010 | Muratani | B65H 7/06 271/264 |

FOREIGN PATENT DOCUMENTS

| | | |
|---|---|---|
| JP | H11-334935 A | 12/1999 |
| JP | 2012-220752 A | 11/2012 |

* cited by examiner

*Primary Examiner* — Howard J Sanders
(74) *Attorney, Agent, or Firm* — IP Business Solutions, LLC

(57) ABSTRACT

A paper conveyance device includes a roller, paper feed sensor, registration sensor, and controller. At a first time point at which specified time from start of draw of paper by the roller to arrival of the paper at the registration sensor has passed, when a detection result by the registration sensor is absence of the paper and a detection result by the paper feed sensor is presence of the paper, and the detection result by the paper feed sensor is the absence at a second time point at which standby time has passed from the first time point, the controller sets a safe paper feed mode in which the draw of the paper by the roller is started at a delay time point at which delay time has passed since a switching time point at which the detection result by the registration roller is switched from the presence to absence.

8 Claims, 13 Drawing Sheets

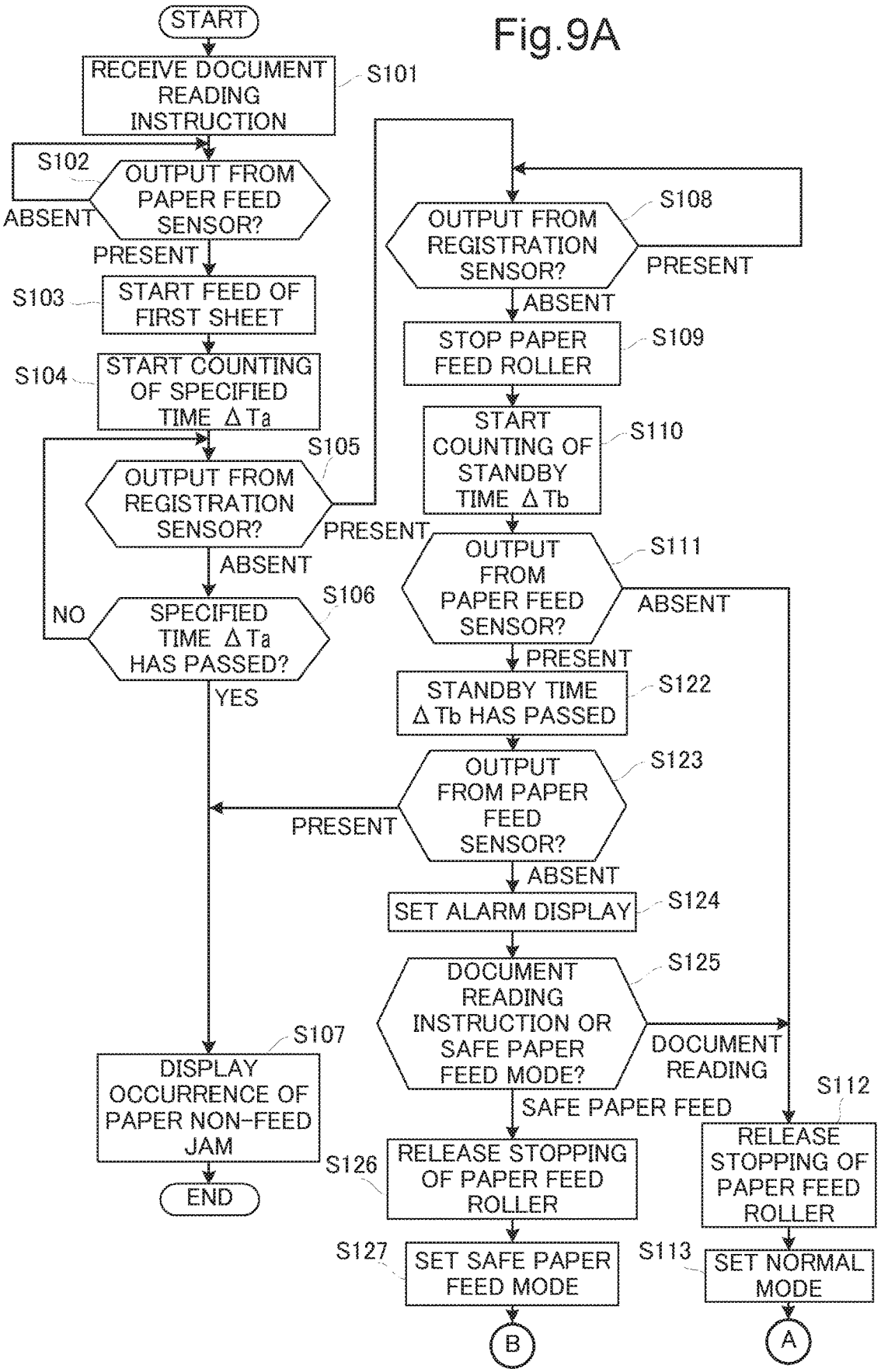
Fig.9A
START
RECEIVE DOCUMENT READING INSTRUCTION
S101
S102
OUTPUT FROM PAPER FEED SENSOR?
ABSENT
PRESENT
S103
START FEED OF FIRST SHEET
S104
START COUNTING OF SPECIFIED TIME ΔTa
S105
OUTPUT FROM REGISTRATION SENSOR?
PRESENT
ABSENT
S106
SPECIFIED TIME ΔTa HAS PASSED?
NO
YES
S107
DISPLAY OCCURRENCE OF PAPER NON-FEED JAM
END
S108
OUTPUT FROM REGISTRATION SENSOR?
PRESENT
ABSENT
S109
STOP PAPER FEED ROLLER
S110
START COUNTING OF STANDBY TIME ΔTb
S111
OUTPUT FROM PAPER FEED SENSOR?
ABSENT
PRESENT
S122
STANDBY TIME ΔTb HAS PASSED
S123
OUTPUT FROM PAPER FEED SENSOR?
PRESENT
ABSENT
S124
SET ALARM DISPLAY
S125
DOCUMENT READING INSTRUCTION OR SAFE PAPER FEED MODE?
DOCUMENT READING
SAFE PAPER FEED
S126
RELEASE STOPPING OF PAPER FEED ROLLER
S127
SET SAFE PAPER FEED MODE
B
S112
RELEASE STOPPING OF PAPER FEED ROLLER
S113
SET NORMAL MODE
A

PAPER CONVEYANCE DEVICE CONVEYING PAPER, IMAGE READING DEVICE, AND IMAGE FORMING APPARATUS

INCORPORATION BY REFERENCE

This application claims priority to Japanese Patent Application No. 2019-094120 filed on May 17, 2019, the entire contents of which are incorporated by reference herein.

BACKGROUND

This disclosure relates to a paper conveyance device conveying paper, and an image reading device and an image forming apparatus provided with the paper conveyance device. More specifically, the disclosure relates to a technology for detecting paper being conveyed.

In a paper conveyance device, a plurality of sheets of paper is sequentially drawn from a paper feed start position and conveyed by a paper feed roller. The paper conveyance device is provided with: a paper feed sensor that detects paper at the paper feed start position; and a registration sensor that detects paper at a position located downstream of the paper feed start position in a paper conveyance direction. Upon detection of the next sheet of paper by the paper feed sensor at a time point at which passage of a rear end of the paper has been detected by the registration sensor, the next sheet of paper is drawn and conveyed by the paper feed roller. Consequently, it is possible to sequentially convey the plurality of sheets of paper at fixed intervals.

For example, in a first sheet feeding device, it is possible to feed a sheet by a paper feed roller, detect the sheet on a conveyance path, execute retry of paper feed when time required for detecting the sheet on the conveyance path since start of the sheet feed has exceeded predefined time, and set the number of times of the retry in accordance with, for example, a state of abrasion of the paper feed roller.

Moreover, in a second sheet feeding device, when paper arrival cannot be detected by a paper sensor within a predefined time period since start of rotation of the paper feed roller, operation of the retry by the paper feed roller is performed the predefined number of times, the final retry is performed after passage of the rear end of the previously fed and preceding paper through the paper feed conveyance path, and when the paper arrival cannot be detected by the paper sensor within the predefined time even when the final retry operation has been performed, the paper feed by the paper feed roller is stopped.

SUMMARY

As one aspect of this disclosure, a technology obtained by further improving the aforementioned technologies will be suggested.

A paper conveyance device according to one aspect of this disclosure includes a roller, a paper feed sensor, a registration roller, and a control device. The roller sequentially draws a plurality of sheets of paper from a paper feed start position and conveys the plurality of sheets of paper. The paper feed sensor detects presence or absence of the paper at the paper feed start position. The registration sensor detects presence or absence of the paper at a position located on a more downstream side than the paper feed start position in a paper conveyance direction. The control device includes a processor and, as a result of execution of a control program by the processor, functions as a controller. The controller is configured to set either of a normal mode, in which a next sheet of the paper is drawn and conveyed by the roller at a switching time point at which a result of the detection by the registration roller is switched from the presence to the absence of the paper, and a safe paper feed mode, in which the draw of the paper by the roller is started at a delay time point at which preset delay time has passed since the switching time point. The controller is further configured to: at a first time point at which specified time from start of the draw of the paper by the roller to arrival of the paper at the registration sensor has passed, when the result of the detection by the registration sensor is the absence of the paper and a result of the detection by the paper feed sensor is the presence of the paper, stand by for preset standby time from the first time point; and at a second time point at which the standby time has passed, when the result of the detection by the paper feed sensor is the absence of the paper, set the safe paper feed mode.

An image reading device according to another aspect of this disclosure includes the paper conveyance device described above, and a reading device reading an image recorded on the paper conveyed by the paper conveyance device.

An image forming apparatus according to still another aspect of this disclosure includes the image reading device described above, and an image forming device recording, on recording paper, the image read by the image reading device.

BRIEF DESCRIPTION OF THE DRAWINGS

FIG. 9A is a flowchart illustrating procedures of processing for setting switching among the normal mode, the safe paper feed mode, and alarm display.

DETAILED DESCRIPTION

Hereinafter, an embodiment of this disclosure will be described with reference to the drawings.

Figure 1:
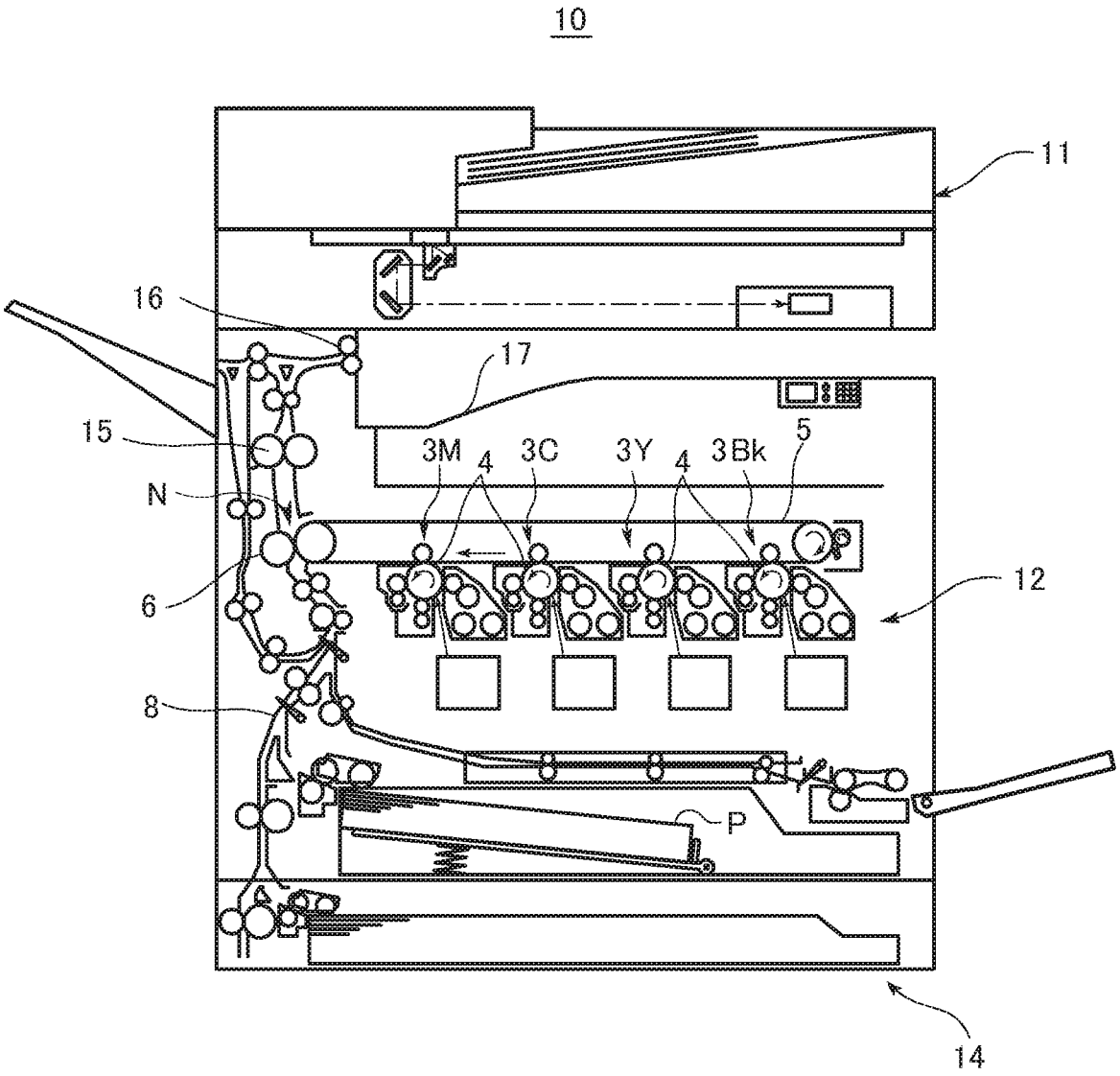
FIG. 1 is a sectional view illustrating one embodiment of an image forming apparatus of this disclosure.

FIG. 1 is a sectional view illustrating an image forming apparatus of one embodiment according to this disclosure. An image forming apparatus 10 includes an image reading device 11 and an image forming device 12. Note that a paper conveyance device according to this disclosure corresponds to configuration obtained by excluding a reading device 30 to be described later on and the image forming device 12 from the image forming apparatus 10.

The image reading device 11 has an image pickup element which optically reads an image of document paper. An analog output of the image pickup element is converted into a digital signal whereby image data indicating the image of the document paper is generated.

The image forming device 12 prints (forms), on recording paper, an image indicated by the aforementioned image data or image data received from an outside, and includes: a magenta image forming unit 3M, a cyan image forming unit 3C, a yellow image forming unit 3Y, and a black image forming unit 3Bk. In each of the image forming units 3M, 3C, 3Y, and 3Bk, a surface of a photoconductive drum 4 is uniformly charged and the surface of the photoconductive drum 4 is exposed to form an electrostatic latent image on the surface of the photoconductive drum 4, so that the electrostatic latent image formed on the surface of the photoconductive drum 4 is developed into a toner image and the toner image formed on the surface of the photoconductive drum 4 is transferred onto an intermediate transfer belt 5. Consequently, a color toner image is formed on the intermediate transfer belt 5. The color toner image is secondarily transferred onto recording paper P conveyed from a paper feed device 14 through a conveyance path 8 at a nip part N formed between the intermediate transfer belt 5 and a secondary transfer roller 6.

Then the recording paper P is heated and pressurized by a fixing device 15 whereby the toner image formed on the recording paper P is fixed through thermal compression, and the recording paper P is further discharged onto a discharge tray 17 through a discharge roller 16.

Figure 2:
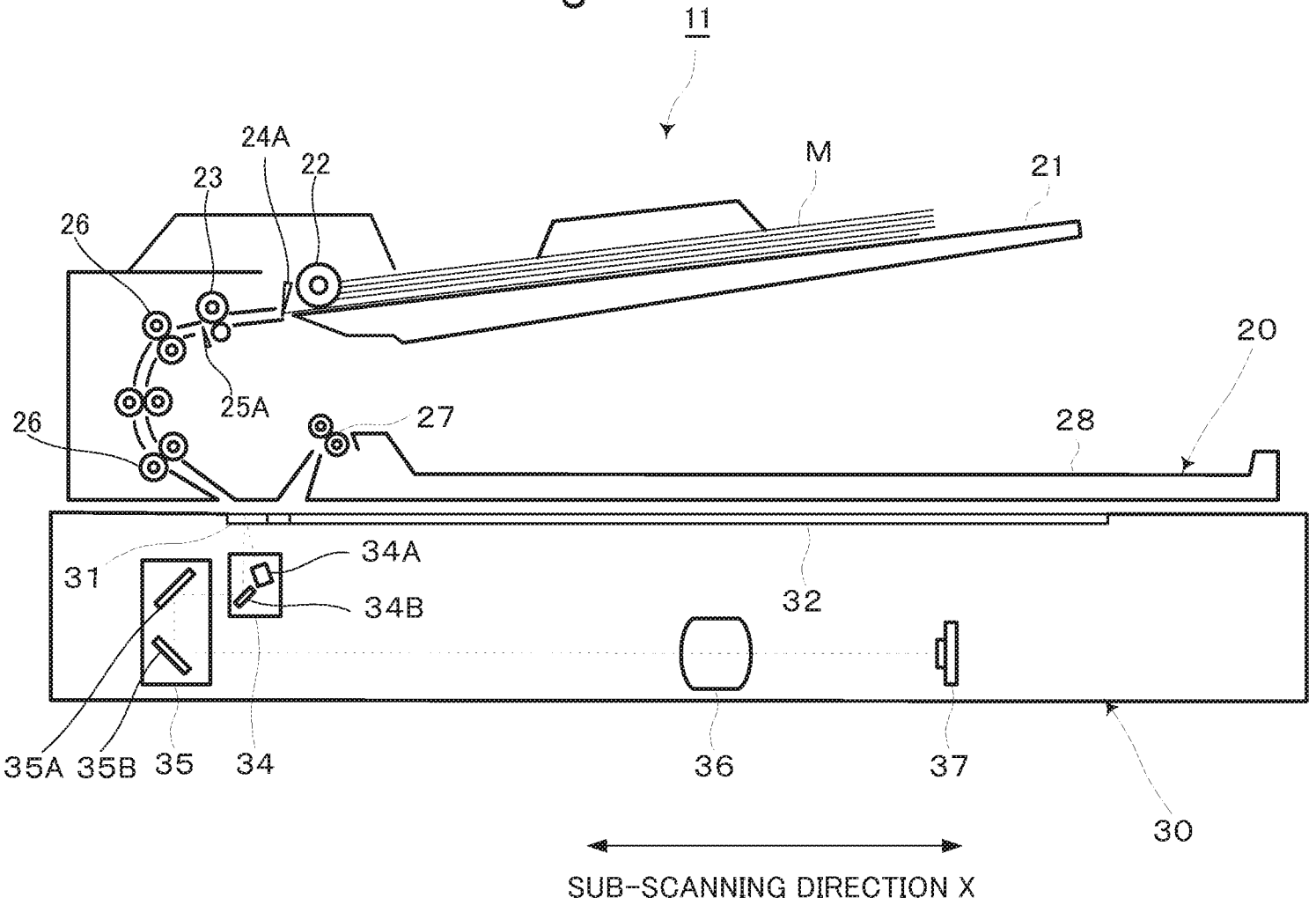
FIG. 2 is a sectional view illustrating an image reading device of this embodiment.
Figure 3:
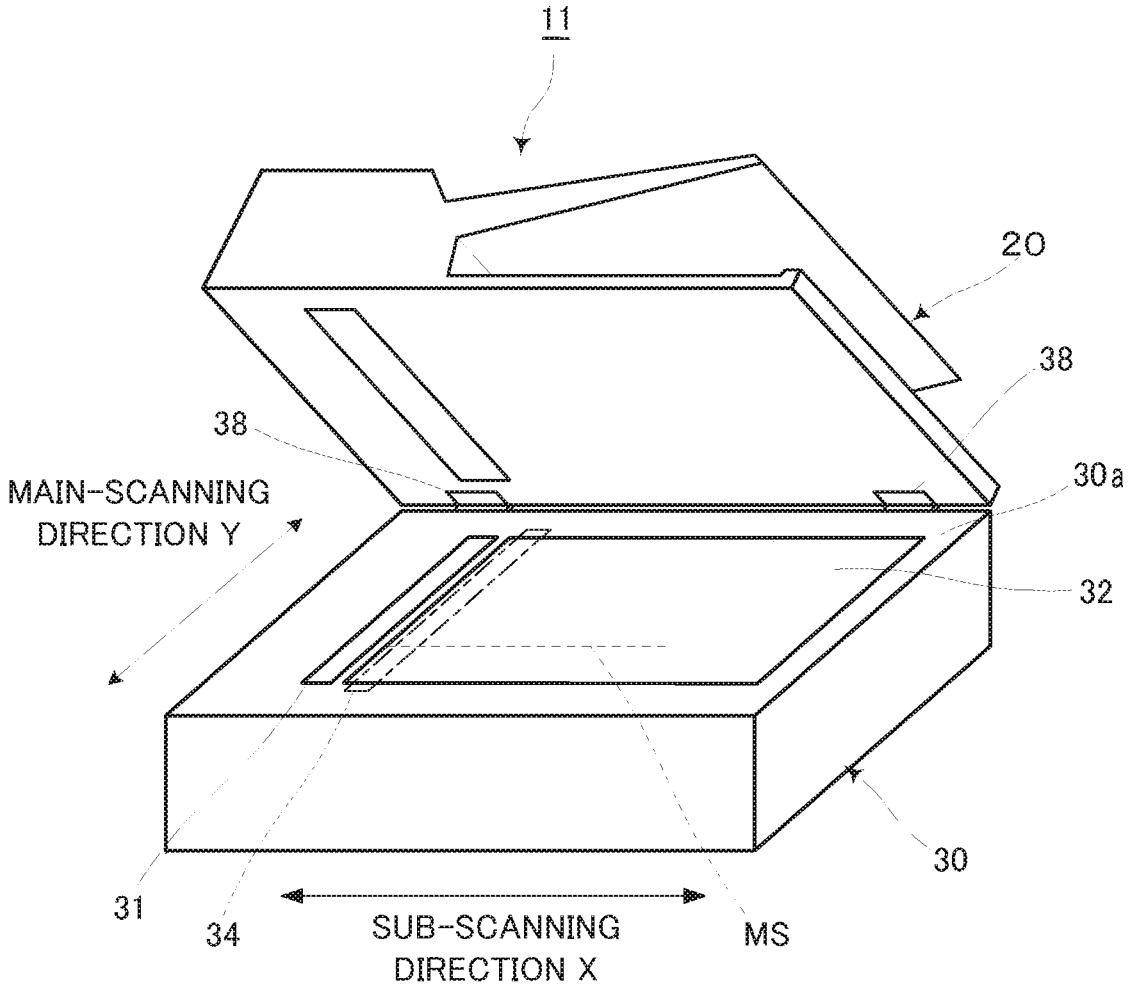
FIG. 3 is a perspective view illustrating outer appearance of the image reading device.

Next, schematic configuration of the image reading device 11 will be described. FIG. 2 is a sectional view illustrating mechanical configuration of the image reading device 11. FIG. 3 is a perspective view illustrating outer appearance of the image reading device 11 in a state in which a document conveyance device 20 is opened.

As illustrated in FIGS. 2 and 3, the image reading device 11 includes the document conveyance device 20 and the reading device 30. The document conveyance device 20 includes a document tray 21, a paper feed roller 22, a registration roller 23, a paper feed sensor 24, a registration sensor 25, a plurality of conveyance rollers 26, a paper discharge roller 27, a document discharge tray 28, etc. Note that the paper feed roller 22 is one example of a roller in Claims. The reading device 30 includes first platen glass 31, second platen glass 32, a carriage 34, an optical system unit 35, a focusing lens 36, a CCD sensor 37, etc.

Here, two hinges 38 are separately provided at one end part of a top surface 30*a* of the reading device 30, and the document conveyance device 20 is supported by the hinges 38 in an openable and closable manner, which permits a user to perform opening and closing operation of the document conveyance device 20.

Upon opening of the document conveyance device 20, the first platen glass 31 and the second platen glass 32 of the reading device 30 are opened, so that the document paper can be loaded onto the second platen glass 32. When the document conveyance device 20 is closed, document paper M loaded on the second platen glass 32 is pushed by the document conveyance device 20. In the reading device 30, while the carriage 34 and the optical system unit 35 are moved in a sub-scanning direction X with predetermined speed relationship maintained therebetween, light of a light source 34A of the carriage 34 irradiates document paper MS through the second platen glass 32, and the light reflected on the document paper MS is reflected on a mirror 34B of the carriage 34. The light is further reflected on a mirror 35A and a mirror 35B of the optical system unit 35, entering the CCD sensor 37 through the focusing lens 36. The CCD sensor 37 repeatedly reads an image of the document paper MS in a main-scanning direction Y (a direction orthogonal to the sub-scanning direction X).

Moreover, while the document conveyance device 20 is closed, sheets of the document paper M loaded on the document tray 21 are individually drawn by the paper feed roller 22 of the document conveyance device 20, and are conveyed in the sub-scanning direction through a top of the first platen glass 31 by the registration roller 23 and each conveyance rollers 26, and the document paper M is discharged onto the document discharge tray 28 by the paper discharge roller 27. In the reading device 30, the carriage 34 and the optical system unit 35 are respectively positioned at predetermined positions, the light of the light source 34A of the carriage 34 irradiates the document paper M through the first platen glass 31, and the light reflected on the document paper M is reflected on each of the mirrors 34B, 35A, and 35B to enter the CCD sensor 37 through the focusing lens 36, causing the CCD sensor 37 to repeatedly read an image of the document paper M in the main-scanning direction Y.

Figure 4:
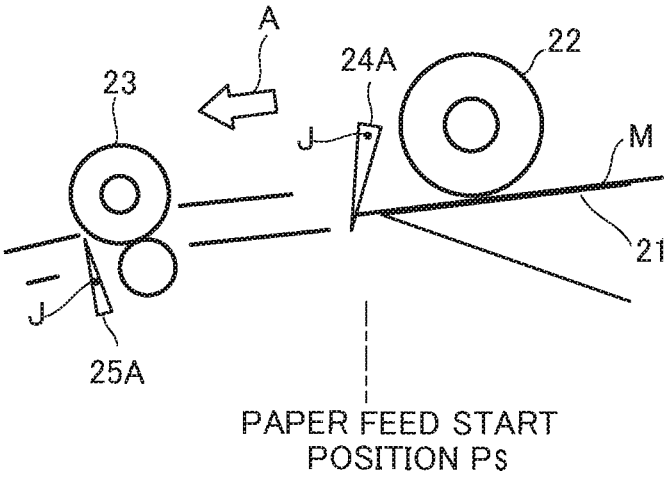
FIG. 4 is a sectional view illustrating, on an enlarged scale, a paper feed roller, a registration roller, a paper feed sensor, a registration sensor, etc. in a document conveyance device of the image reading device.

Further, a description will be given with reference to FIG. 4. FIG. 4 is a sectional view illustrating, on an enlarged scale, the paper feed roller 22, the registration roller 23, the paper feed sensor 24, and the registration sensor 25 in the document conveyance device 20. As illustrated in FIG. 4, the paper feed roller 22 is provided on an upstream side of the document paper M in a conveyance direction A, the registration roller 23 is provided on a downstream side thereof, the paper feed sensor 24 is provided near a downstream side of the paper feed roller 22, and the registration sensor 25 is provided near a downstream side of the registration roller 23.

For example, rotation of a conveyance motor (illustrated in FIG. 5) is transmitted from a driving unit (not illustrated) composed of a gear, etc., as a result of which the paper feed roller 22 and the registration roller 23 are driven into rotation. The driving unit is also provided with an electromagnetic clutch (illustrated in FIG. 5) for making switching between transmission and blocking of the rotation of the registration roller 23, etc., making it possible to temporarily stop the registration roller 23.

The document paper M is drawn from the document tray 21 and conveyed by the paper feed roller 22 and is caused to abut the registration roller 23 temporarily stopped, with a tip thereof aligned in parallel with the registration roller 23. Then the rotation of the registration roller 23 is started according to operation of reading the document paper M by the reading device 30 and the document paper M is conveyed to the first platen glass 31 of the reading device 30.

The paper feed sensor 24 detects the presence or absence of the document paper M on the document tray 21, and includes: for example, an oscillation lever 24A which is supported in a manner such as to be rotatable around an axis; and a detection device 24B (see FIG. 5) which detects a rotation position of the oscillation lever 24A. The oscillation lever 24A is rotatably supported by an axis J located at a position higher than the gravity of the oscillation lever 24A and is biased by own weight with a tip thereof oriented downward, and the tip of the oscillation lever 24A is pushed up when the tip is usually oriented downward and the tip of the document paper M is located at a paper feed start position Ps on the document tray 21. The detection device 24B has, for example, a light-emitting element and a light-receiving element for receiving light of the light-emitting element, which are arranged on both sides of the oscillation lever 24A oppositely to each other. When the tip of the oscillation lever 24A is oriented downward (or may be when the tip is pushed up), a portion of the oscillation lever 24A lies between the light-emitting element and the light-receiving element and light of the light emitting element is blocked by the aforementioned portion of the oscillation lever 24A and is not received by the light-receiving element. When the tip is pushed upward (or may be when the tip is oriented downward), the aforementioned portion of the oscillation lever 24A is detached from an area between the light emitting element and the light-receiving element and the light of the light emitting element is received by the light-receiving element. Based on a detection output of the light-receiving element, the paper feed sensor 24 outputs a signal indicating the presence or absence of the document paper M located at the paper feed start position Ps on the document tray 21. The signal outputted as described above is referred to as a detection output.

The registration sensor 25 detects the presence or absence of the document paper M near the registration roller 23 and includes: for example, an oscillation lever 25A which is supported in a manner such as to be rotatable around an axis; and a detection device 25B (see FIG. 5) which detects a rotation position of the oscillation lever 25A. The oscillation lever 25A is supported in a manner such as to be rotatable around an axis J located at a position higher than the gravity of the oscillation lever 25A, with a tip of the oscillation lever 25A biased by the own weight of the oscillation lever 25A, and the tip is usually oriented upward and the tip is pushed down by the document paper M which has passed through the registration roller 23. The detection device 25B has: for example, a light-emitting element and a light-receiving element for receiving light of the light-emitting element, which are arranged on both sides of the oscillation lever 25A oppositely to each other. When a tip of the detection device 25B is oriented upward (or may be when the tip is pushed down), a portion of the oscillation lever 25A lies between the light-emitting element and the light-receiving element, so that the light of the light-emitting element is blocked by the aforementioned portion of the oscillation lever 25A and not received by the light-receiving element. When the tip of the detection device 25B is pushed down (or may be when the tip is oriented upward), the aforementioned portion of the oscillation lever 25A is detached from the area between the light-emitting element and the light-receiving element and the light of the light emitting element is received by the light-receiving element. Based on a detection output of the light-receiving element, the registration sensor 25 outputs a signal indicating the presence or absence of the document paper M which has passed through the registration roller 23. A signal outputted as described above is referred to as a detection output.

Figure 5:
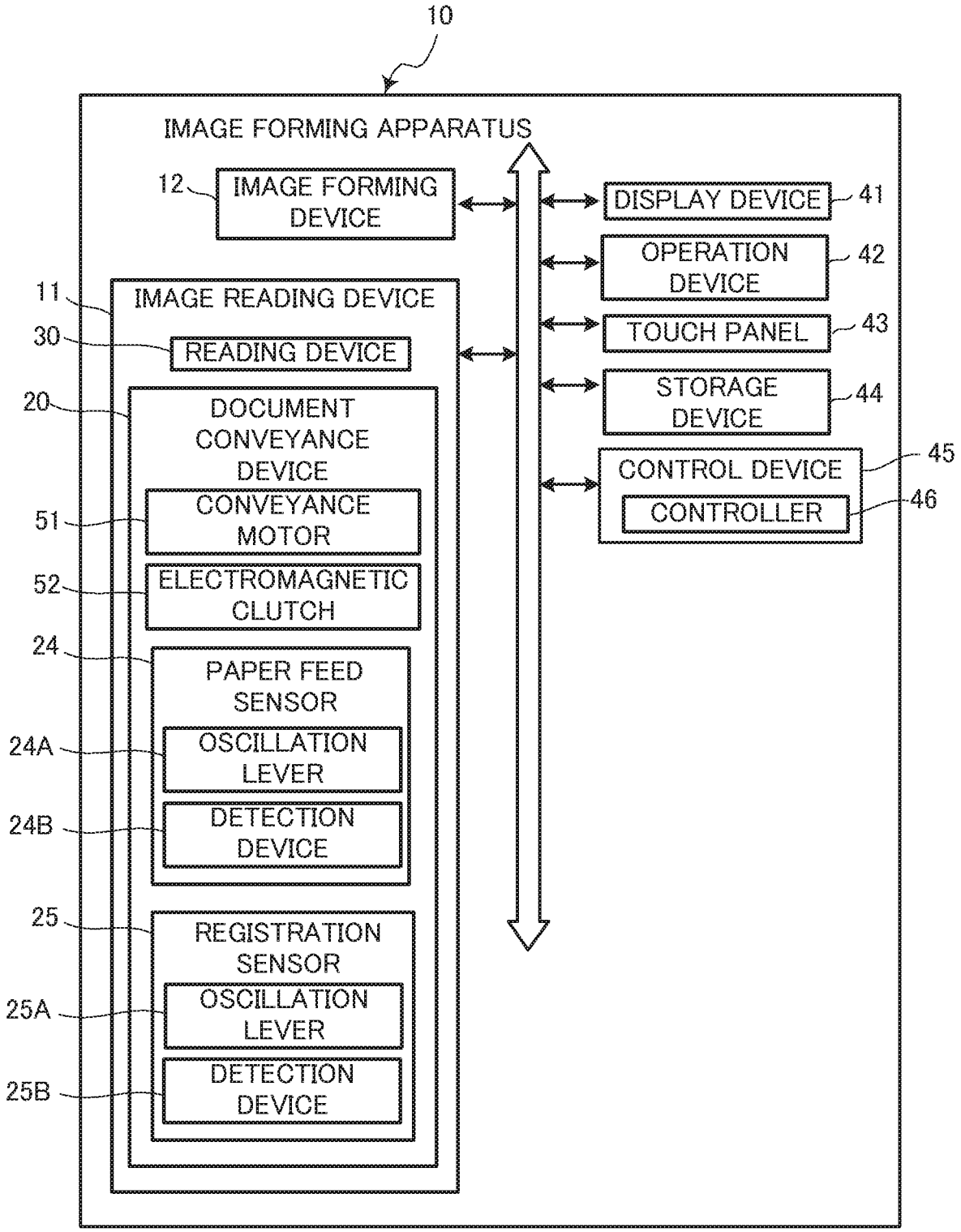
FIG. 5 is a functional block diagram illustrating main inner configuration of the image forming apparatus.

Next, configuration of control of the image forming apparatus 10 will be described. FIG. 5 is a functional block diagram illustrating main inner configuration of the image forming apparatus 10. As illustrated in FIG. 5, the image forming apparatus 10 includes: the image reading device 11, the image forming device 12, a display device 41, an operation device 42, a touch panel 43, a storage device 44, a control device 45, etc. These components are capable of transmitting and receiving data or a signal to and from each other through a bus.

The display device 41 is formed of, for example, a liquid crystal display (LCD) or an organic light-emitting diode (OLED) display.

The operation device 42 includes hard keys such as a numeric keypad, a determine key, a start key, etc. and is operated by a user.

The touch panel 43 is superposed on a screen of the display device 41. The touch panel 43 detects, for example, touch of a finger of the user on the touch panel 43 together with a position of the aforementioned touch and receives input of user's instruction to the screen of the display device 41.

The storage device 44 is composed of a random access memory (RAM), a large-capacity hard disk drive (HDD), etc. and stores various pieces of data and programs.

The control device 45 is composed of: a processor, a RAM, a read only memory (ROM), etc. The processor is, for example, a central processing unit (CPU), an application specific integrated circuit (ASIC), or a micro processing unit (MPU). The control device 45 functions as a controller 46 as a result of execution of a control program stored in the aforementioned ROM or storage device 44 by the processor.

The control device 45 is in charge of overall control of the image forming apparatus 10. The control device 45 is connected to the image reading device 11, the image forming device 12, the display device 41, the operation device 42, the touch panel 43, the storage device 44, etc. and performs control of the aforementioned components and signal or data transmission and reception between the components.

The controller 46 plays a role as a processing device that executes various types of processing. The controller 46 also has a function of controlling the display device 41.

Moreover, the image reading device 11 includes: a conveyance motor 51 that drives the paper feed roller 22, the registration roller 23, etc. into rotation via a driving unit (not illustrated) composed of a gear, etc. as described above; an electromagnetic clutch 52 that is provided in the driving unit for the purpose of switching between transmission and blocking of the rotation to and from the registration roller 23, etc.; the paper feed sensor 24 that detects the presence or absence of the document paper M on the document tray 21; the registration sensor 25 that detects the presence or absence of the document paper M near the registration roller 23; and so on. The conveyance motor 51 is, for example, a stepping motor.

Based on the detection outputs of the paper feed sensor 24 and the registration sensor 25, the controller 46 controls rotation and stopping of the conveyance motor 51 and contact and separation of the electromagnetic clutch 52 to individually rotate or stop the paper feed roller 22, the registration roller 23, etc. to convey the document paper M.

Next, the conveyance of the document paper M in the document conveyance device 20 of the image reading device 11 will be described in detail.

In the image forming apparatus 10 of this embodiment, based on the detection outputs of the paper feed sensor 24 and the registration sensor 25, the controller 46 sets any of a normal mode, a safe paper feed mode, and alarm display. In the normal mode and the safe paper feed mode, draw and conveyance of the document paper M on the document tray 21 are performed by the paper feed roller 22 and the registration roller 23 of the document conveyance device 20. The normal mode is a mode which is set when the detection of the document paper M on the document tray 21 is normally performed by the paper feed sensor 24 and which is provided for the purpose of shortening a paper interval between the sheets of the document paper M, sequentially drawing and conveying the sheets of the document paper M to achieve an increase in a speed at which each sheet of the document paper M is read. The safe paper feed mode is a mode which is set when erroneous detection of the document paper M on the document tray 21 by the paper feed sensor 24 has occurred and which is provided for the purpose of lengthening the paper interval between the sheets of the document paper M and sequentially drawing and conveying the sheets of the document paper M without being affected by the erroneous detection. The alarm display is set by the controller 46 when the erroneous detection of the document paper M on the document tray 21 by the paper feed sensor 24 has occurred, and the alarm display is set for the purpose of displaying, on the display device 41, a message prompting resetting of the document paper M on the document tray 21.

Figure 6A:
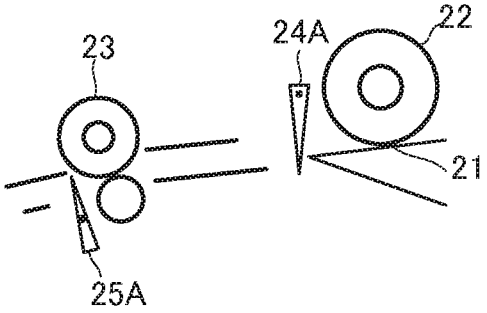
FIGS. 6A to 6F are diagrams each illustrating a process of conveying document paper in a normal mode in a document conveyance device.

FIGS. 6A to 6F are diagrams each illustrating a process of conveying the document paper M in the normal mode. As illustrated in FIG. 6A, when the document paper M is not present on the document tray 21 and the document paper M is not conveyed near the downstream side of the registration roller 23, the tip of the oscillation lever 24A of the paper feed sensor 24 is oriented downward and the detection output of the paper feed sensor 24 indicates the absence of the document paper M, and also the tip of the oscillation lever 25A of the registration sensor 25 is oriented upward and the detection output of the registration sensor 25 indicates the absence of the document paper M.

Figure 6B:
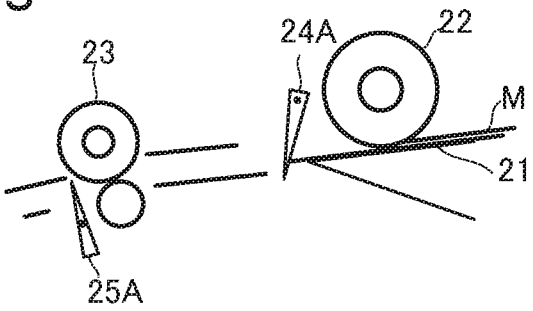

As illustrated in FIG. 6B, when the document paper M has been set on the document tray 21 and the tip of the document paper M on the document tray 21 has been moved to the paper feed start position Ps by the paper feed roller 22 in a state in which the tip of the oscillation lever 25A of the registration sensor 25 is oriented upward and the detection output of the registration sensor 25 indicates the absence of the document paper M, the tip of the oscillation lever 24A of the paper feed sensor 24 is pushed upward by the tip of the document paper M and the detection output of the paper feed sensor 24 indicates the presence of the document paper M.

Figure 6C:
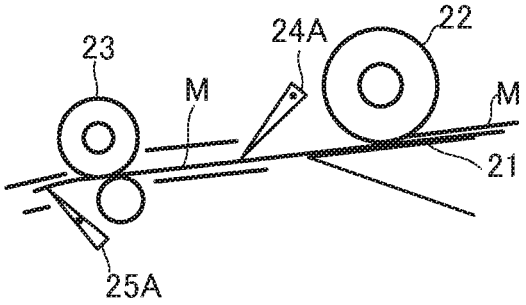
Figure 6D:
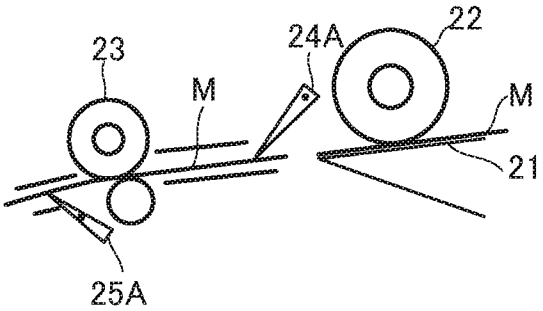

At this point, the controller 46 starts control of driving the conveyance motor 51, the electromagnetic clutch 52, etc. based on the detection output of the paper feed sensor 24 and the detection output of the registration sensor 25, rotates the paper feed roller 22, causing the paper feed roller 22 to draw the document paper M on the document tray 21, and brings the tip of the document paper M to abut the registration roller 23 temporarily stopped, subsequently causing the registration roller 23 to convey the document paper M. Consequently, as illustrated in FIGS. 6C and 6D, the document paper M is conveyed, the tip of the oscillation lever 24A of the paper feed sensor 24 is pushed upward by the tip of the document paper M, the detection output of the paper feed sensor 24 indicates the presence of the document paper M, and the tip of the oscillation lever 25A of the registration sensor 25 is pushed down by the document paper M passing through the registration roller 23, and the detection output of the registration sensor 25 indicates the presence of the document paper M.

Figure 6E:
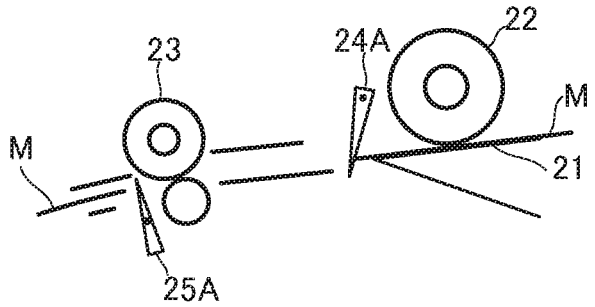

Then as illustrated in FIG. 6E, the document paper M is conveyed to the downstream side of the registration roller 23, the tip of the oscillation lever 25A of the registration sensor 25 is oriented upward, and the detection output of the registration sensor 25 is switched from the presence to the absence of the document paper M, upon which the tip of the document paper M on the document tray 21 is moved to the paper feed start position Ps by the paper feed roller 22, whereby the tip of the oscillation lever 24A of the paper feed sensor 24 is pushed up by the tip of the document paper M and the detection output of the paper feed sensor 24 indicates the presence of the document paper M.

Thus, as is the case with FIG. 6B, the controller 46 controls the conveyance motor 51, the electromagnetic clutch 52, etc. based on the detection output of the paper feed sensor 24 and the detection output of the registration sensor 25, causing the paper feed roller 22 to draw the next sheet of the document paper M on the document tray 21 and bring the tip of the document paper M to abut the registration roller 23, further causing the registration roller 23 to convey the document paper M.

Similarly, when the detection output of the registration sensor 25 is switched from the presence to the absence of the document paper M after the last sheet of the document paper M is conveyed to the downstream side of the registration roller 23, the tip of the next sheet of the document paper M on the document tray 21 is moved to the paper feed start position Ps, bringing about a state in which the detection output of the paper feed sensor 24 indicates the presence of the document paper M, and the next sheet of the document paper M on the document tray 21 is drawn by the paper feed roller 22 and conveyed by the registration roller 23.

Consequently, the paper interval between the sheets of the document paper M are shortened, the sheets of the document paper M are sequentially conveyed, and images of the sheets of the document paper M are sequentially read by the reading device 30.

Figure 6F:
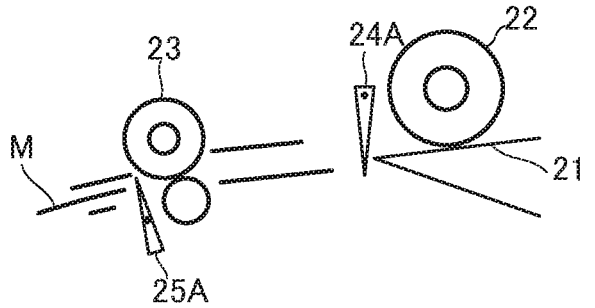

Moreover, as illustrated in FIG. 6F, when no document paper M is present on the document tray 21, the last sheet of the document paper M is conveyed to the downstream side of the registration roller 23 and the tip of the oscillation lever 25A of the registration sensor 25 is oriented upward, and even when the detection output of the registration sensor 25 is switched from the presence to the absence of the document paper M, the tip of the document paper M on the document tray 21 is not moved to the paper feed start position Ps by the paper feed roller 22, the tip of the oscillation lever 24A of the paper feed sensor 24 is oriented downward, and the detection output of the paper feed sensor 24 indicates the absence of the document paper M.

At this point, based on the detection outputs of the paper feed sensor 24 and the registration sensor 25, the controller 46 stops the conveyance motor 51, the electromagnetic clutch 52, etc., ending the conveyance of the document paper M by the document conveyance device 20.

Figure 7A:
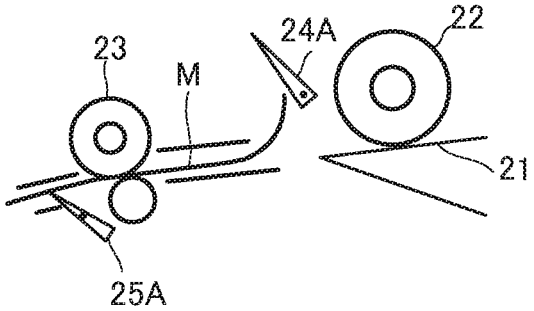
FIGS. 7A to 7D are diagrams each illustrating a process of conveying document paper whose rear end part is warped.

Here, in a state in which a rear end part of the document paper M is warped upward as illustrated in FIG. 7A, the tip of the oscillation lever 24A of the paper feed sensor 24 is greatly bounced upward by the rear end part of the document paper M. The detection output of the paper feed sensor 24 also indicates the presence of the document paper M at this point.

Figure 7B:
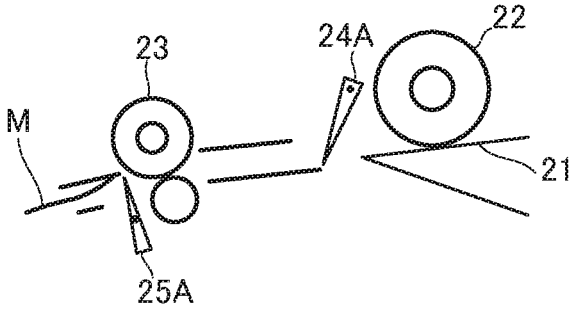

However, since the tip of the oscillation lever 24A of the paper feed sensor 24 is greatly bounced upward, time required for the tip of the oscillation lever 24A of the paper feed sensor 24 to be oriented downward increases. Thus, as illustrated in FIG. 7B, at a time point at which the detection output of the registration sensor 25 is switched from the presence to the absence of the document paper M as a result of the passage of the document paper M through the registration roller 23, the detection output of the paper feed sensor 24 indicates the presence of the document paper M regardless of whether the document paper M is present or absent on the document tray 21.

Figure 7C:
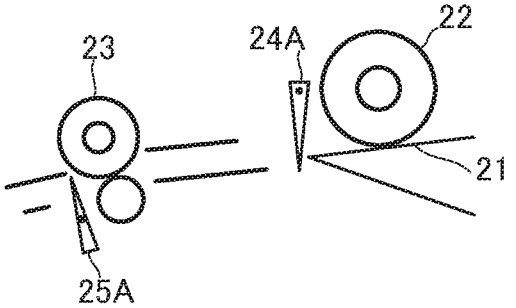
Figure 7D:
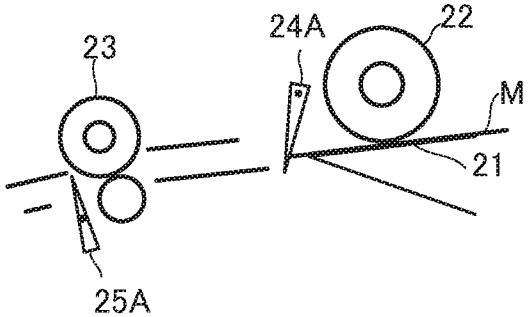

However, as illustrated in FIG. 7D, the tip of the oscillation lever 24A of the paper feed sensor 24 is oriented downward with time passage. Thus, in a state in which the rotation operation of the paper feed roller 22 for moving the tip of the document paper M on the document tray 21 to the paper feed start position Ps is temporarily stopped, if the detection output of the paper feed sensor 24 indicates the presence of the document paper M upon the switching of the detection output of the registration sensor 25 from the presence to the absence of the document paper M and then if the detection output of the paper feed sensor 24 indicates the absence of the document paper M upon passage of sufficient time required for the tip of the oscillation lever 24A of the paper feed sensor 24 to be oriented downward, the controller 46 sets alarm display considering that the rear end part of the document paper M is warped upward. For example, upon the setting of the alarm display, the controller 46 causes the display device 41 to display a message prompting resetting of the document paper M on the document tray 21.

Moreover, the controller 46 detects, through the touch panel 43, user operation performed on a screen of the alarm display and sets the safe paper feed mode in accordance with the user operation.

Figure 8:
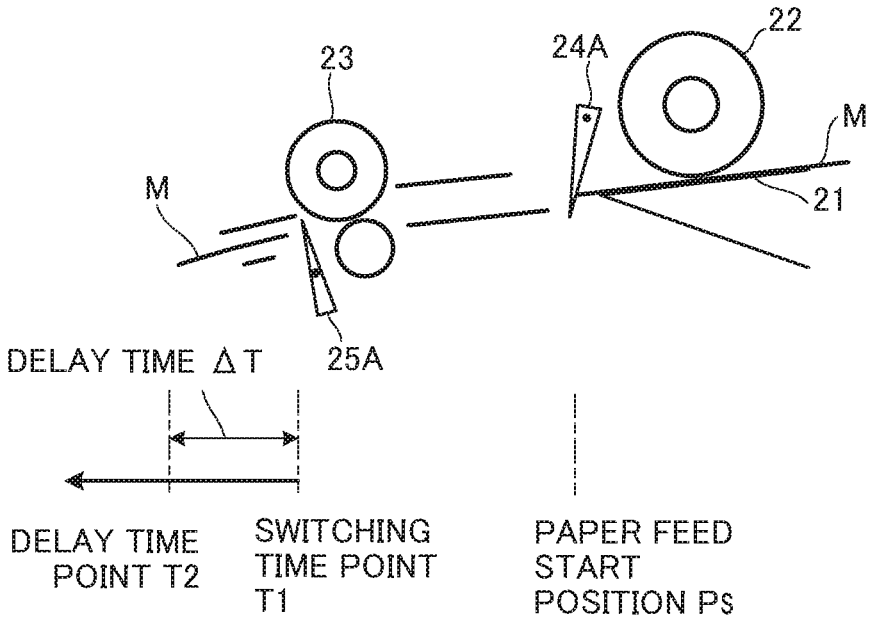
FIG. 8 is a diagram used for explaining relationship between detection of the document paper by the registration sensor and start of draw of a next sheet of document paper in the normal mode and a safe paper feed mode.

The safe paper feed mode will be described. Upon feeding the next sheet of the document paper M, the controller 46 assumes that a time point at which the detection output of the registration sensor 25 is switched from the presence to the absence as a result of passing of the rear end part of the last document paper M through the position of the registration sensor 25 is a switching time point T1, as illustrated in FIG. 8. Then a time point at which fixed delay time ΔT has passed since the switching time point T1 is set as a delay time point T2. That is, time predefined as being required for the tip of the oscillation lever 24A to be oriented downward as illustrated in FIG. 7C since the switching time point T1 is set as delay time ΔT. The controller 46 starts the control of driving the conveyance motor 51, the electromagnetic clutch 52, etc. under condition that the detection output of the paper feed sensor 24 is the presence of the paper and the detection output of the registration sensor 25 is the absence of the paper at the delay time point T2, causing the paper feed roller 22 to convey the document paper M on the document tray 21 towards the registration roller 23.

For example, when the detection output of the paper feed sensor 24 indicates the absence of the document paper M at the delay time point T2 as illustrated in FIG. 7C, the controller 46 stops the conveyance motor 51, the electromagnetic clutch 52, etc. to end the conveyance of the document paper M by the document conveyance device 20.

Moreover, when the detection output of the paper feed sensor 24 indicates the presence of the document paper M at the delay time point T2 as illustrated in FIG. 7D, the controller 46 controls the conveyance motor 51, the electromagnetic clutch 52, etc. causing the paper feed roller 22 to draw the next sheet of the document paper M on the document tray 21.

In such a safe paper feed mode, the document paper M is drawn and conveyed at the delay time point T2 which is delayed by the delay time ΔT than the switching time point T1, and thus the paper interval between the sheets of the document paper M is lengthened but even when the rear end part of the document paper M is warped upward and the tip of the oscillation lever 24A of the paper feed sensor 24 is greatly bounced upward than the rear end part of the document paper M, the tip of the oscillation lever 24A is oriented downward during the delay time ΔT, so that the paper feed sensor 24 can reliably detect the presence or absence of the tip of the document paper M and the paper feed roller 22 can draw the document paper M without idling of the paper feed roller 22.

Figure 9B:
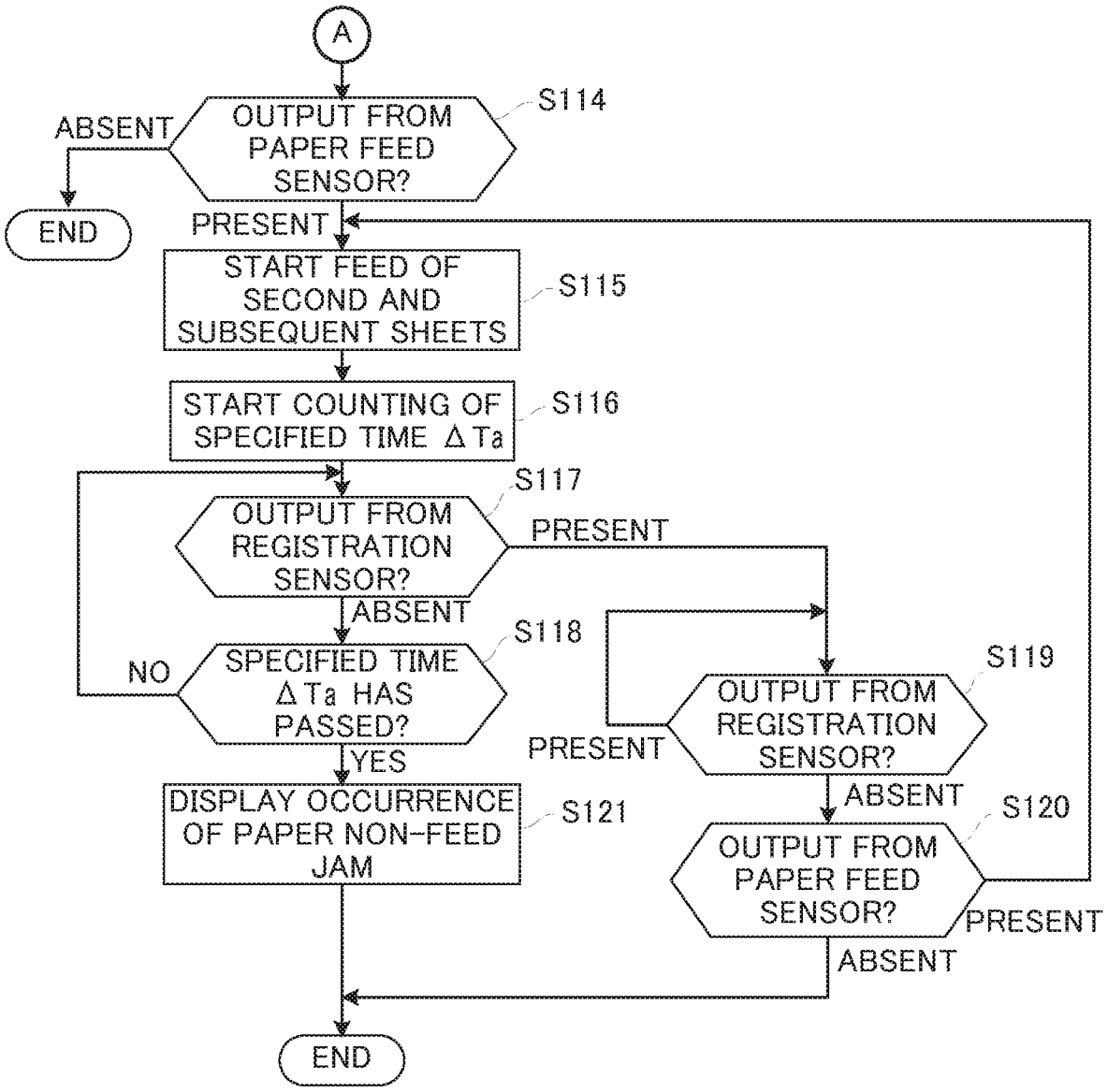
FIG. 9B is a flowchart illustrating procedures of processing performed in the normal mode, following FIG. 9A.

Next, procedures of processing for switching setting of the normal mode, the safe paper feed mode, and the alarm display of the document conveyance device 20 of the image reading device 11 as described above will be described with reference to, for example, flowcharts illustrated in FIGS. 9A, 9B, and 9C in an organized manner.

First, the user sets the document paper M on the document tray 21 of the document conveyance device 20 and operates the start key of the operation device 42 to input a document reading instruction. Upon receiving the document reading instruction (S101), the controller 46 rotates the paper feed roller 22 in order to move the tip of the first sheet of the document paper M on the document tray 21 to the paper feed start position Ps, and determines whether or not the detection output of the paper feed sensor 24 indicates the presence of the document paper M (S102). If the detection output of the paper feed sensor 24 indicates the absence of the document paper M ("Absent" in S102), the controller 46 stands by until the detection output of the paper feed sensor 24 indicates the presence of the document paper M.

Figure 10:
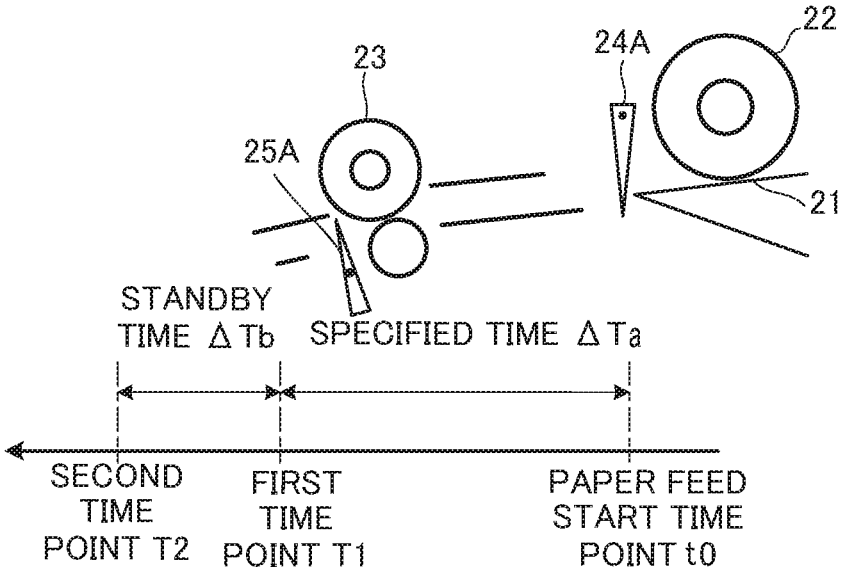
FIG. 10 is a diagram used for explaining relationship between start of feeding document paper and detection of the document paper by the registration sensor in the normal mode.

Moreover, when the detection output of the paper feed sensor 24 indicates the presence of the document paper M ("Present" in S102), the controller 46 further rotates the paper feed roller 22, causing the paper feed roller 22 to draw the document paper M on the document tray 21, and brings the tip of the document paper M to abut the registration roller 23 temporarily stopped, subsequently causing the registration roller 23 to convey the first sheet of the document paper M (S103). Moreover, the controller 46 starts counting of specified time Δta from a paper feed start time point t0 (S104). As illustrated in FIG. 10, the specified time Δta is time predefined as time which satisfactorily permits arrival of the document paper M at the registration sensor 25 since the paper feed start time point t0.

The controller 46 determines whether or not the detection output of the registration sensor 25 is switched from the absence to the presence of the document paper M (S105) and determines whether or not the specified time Δta has passed (S106).

For example, when the specified time Δta has passed ("Yes" in S106) without switching of the detection output of the registration sensor 25 from the absence to the presence of the document paper M ("Absent" in S105), that is, when the registration sensor 25 has not detected the document paper M at a first time point t1 at which the specified time Δta has passed since the paper feed start time point t0 as illustrated in FIG. 10, the document paper M is absent on the document tray 21 and feeding of the document paper M is consequently not performed. Thus, the controller 46 assumes that paper non-feed jam has occurred, causing the display device 41 to display a message indicating that the paper non-feed jam has occurred (S107), and stops the conveyance motor 51, the electromagnetic clutch 52, etc. to end the conveyance of the document paper M by the document conveyance device 20, ending the processing illustrated in FIG. 9A.

Moreover, when the detection output of the registration sensor 25 is switched from the absence to the presence of the document paper M ("Present" in S105) before the passage of the specified time Δta ("No" in S106), the first document paper M on the document tray 21 is drawn and conveyed by the paper feed roller 22 and the registration roller 23.

At this point, the controller 46 stands by for further switching of the detection output of the registration sensor 25 from the presence to the absence of the document paper M ("Present" in S108), and upon the switching of the detection output from the presence to the absence ("Absent" in S108), that is, upon passage of the first sheet of the document paper M through a position of the registration sensor 25, the controller 46 stops the rotation operation of the paper feed roller 22 (S109). As a result of stopping the rotation operation of the paper feed roller 22, the tip of the second sheet of the document paper M on the document tray 21 is not moved to the paper feed start position Ps and the second sheet of the document paper M is not detected by the paper feed sensor 24.

Then as illustrated in FIG. 10, the controller 46 starts counting of the predefined standby time Δtb from the first time point t1 (S110) and determines the detection output of the paper feed sensor 24 (S111). For example, unless the rear end part of the first sheet of the document paper M on the document tray 21 is warped upward, the tip of the oscillation lever 24A of the paper feed sensor 24 is quickly oriented downward, so that the controller 46 determines that the detection output of the paper feed sensor 24 indicates the absence ("Absent" in S111), releases the stopping of the rotation operation of the paper feed roller 22 (S112), and sets the normal mode (S113).

Therefore, unless the rear end part of the first sheet of the document paper M on the document tray 21 is warped upward, the normal mode is set.

In the normal mode, the controller 46 rotates the paper feed roller 22 in order to move the tip of the second sheet of the document paper M on the document tray 21 to the paper feed start position Ps and determines whether or not the detection output of the paper feed sensor 24 indicates the presence of the document paper M (S114). When the detection output of the paper feed sensor 24 indicates the absence of the document paper M ("Absent in S114), the controller 46 stops the conveyance motor 51, the electromagnetic clutch 52, etc. to end the conveyance of the document paper M by the document conveyance device 20. Then the processing illustrated in FIG. 9B ends.

Moreover, when the detection output of the paper feed sensor 24 indicates the presence of the document paper M ("Present" in S114), the controller 46 rotates the paper feed roller 22, causing the paper feed roller 22 to draw the second sheet of the document paper M on the document tray 21 and brings the tip of the document paper M to abut the registration roller 23 temporarily stopped, subsequently causing the registration roller 23 to convey the document paper M (S115). Moreover, as illustrated in FIG. 10, where time which satisfactorily permits arrival of the document paper M at the registration sensor 25 since the paper feed start time point t0 is specified time Δta, the controller 46 starts the counting of the specified time Δta from the paper feed start time point t0 (S116).

The controller 46 determines whether or not the detection output of the registration sensor 25 is switched from the absence to the presence of the document paper M (S117) and also determines whether or not the specified time Δta has passed (S118).

For example, when the detection output of the registration sensor 25 is switched from the absence to the presence of the document paper M ("Present" in S117) before the passage of the specified time Δta ("No" in S118), the controller 46 stands by for further switching of the detection output of the registration sensor 25 from the presence to the absence of the document paper M ("Present in S119). Upon the switching of the detection output from the presence to the absence ("Absent" in S119), the controller 46 causes the rotation operation of the paper feed roller 22 in order to move the tip of the document paper M on the document tray 21 to the paper feed start position Ps and determines whether or not the detection output of the paper feed sensor 24 indicates the presence of the document paper M (S120). Then when the detection output of the paper feed sensor 24 indicates the presence of the document paper M ("Present" in S120), the controller 46 returns to S115 and causes the paper feed roller 22 and the registration roller 23 to draw and convey the next sheet of the document paper M. Similarly, when the next sheet of the document paper M is set on the document tray 21, the processing S115 to S120 is repeated and the sheets of the document paper M are sequentially drawn and conveyed at short paper intervals.

Moreover, when the detection output of the paper feed sensor 24 indicates the absence of the document paper M ("Absent" in S120) even when the rotation operation of the paper feed roller 22 for the purpose of moving the tip of the document paper M on the document tray 21 to the paper feed start position Ps is performed, the controller 46 stops the conveyance motor 51, the electromagnetic clutch 52, etc. when the document paper M is absent on the document tray 21, ending the conveyance of the document paper M by the document conveyance device 20. Then the processing illustrated in FIG. 9B ends.

Moreover, upon the passage of the specified time Δta ("Yes" in S118) without the switching of the detection output of the registration sensor 25 from the absence to the presence of the document paper M ("Absent" in S117), that is, when the registration sensor 25 has not detected the document paper M at the first time point t1 at which the specified time Δta has passed since the paper feed start time point t0 as illustrated in FIG. 10, the next sheet of the document paper M is absent on the document tray 21 and feeding of the next sheet of the document paper M is not consequently performed. At this point, the controller 46 assumes that paper non-feed jam has occurred, causing the display device 41 to display a message indicating that the paper non-feed jam has occurred (S121), and stops the conveyance motor 51, the electromagnetic clutch 52, etc. to end the conveyance of the document paper M by the document conveyance device 20, ending the processing illustrated in FIG. 9B.

On the other hand, when the controller 46 has determined in S111 that the detection output of the paper feed sensor 24 indicates the presence ("Present" in S111), there is possibility that a phenomenon has occurred in which, due to the upward warp of the rear end part of the document paper M as illustrated in FIGS. 7A and 7B, the tip of the oscillation lever 24A of the paper feed sensor 24 is greatly bounced upward by the rear end part of the document paper M, and even when the detection output of the registration sensor 25 indicates the absence of the document paper M as a result of the passage of the document paper M through the registration roller 23, the detection output of the paper feed sensor 24 continuously indicates the presence of the document paper M.

Thus, in case of "Present" in S111, the controller 46 further counts the standby time Δtb from the first time point t1 as illustrated in FIG. 10. At a time point at which the standby time Δtb has passed (S122), the controller 46 checks whether or not the detection output of the paper feed sensor 24 indicates the presence of the document paper M (S123).

As is the case with the delay time ΔT, the standby time Δtb is time required for the tip of the oscillation lever 24A to be oriented downward. The standby time Δtb and the delay time ΔT are different from each other in that the standby time Δtb is counted from the first time point t1 at which the specified time Δta has passed since the paper feed start time point t0 while the delay time ΔT is counted from the time point T1 at which the detection output of the registration sensor 25 is switched from the presence to the absence.

For example, when the detection output of the paper feed sensor 24 indicates the presence of the document paper M at the second time point t2 ("Present" in S123), the controller 46 assumes that there is no possibility that the aforementioned phenomenon has occurred but paper non-feed jam has occurred due to some other reason, causing the display device 41 to display a message indicating that the paper non-feed jam has occurred (S107), and stops the conveyance motor 51, the electromagnetic clutch 52, etc. to end the conveyance of the document paper M by the document conveyance device 20. Then the processing illustrated in FIG. 9A ends.

Moreover, when the detection output of the paper feed sensor 24 indicates the absence of the document paper M at the second time point t2 ("Absent" in S123), the controller 46 assumes that the tip of the oscillation lever 24A has been oriented downward as illustrated in FIG. 7C and the detection output of the paper feed sensor 24 has indicated the absence of the document paper M during the standby time Δtb after the aforementioned phenomenon, and sets the alarm display, causing the display device 41 to display a message prompting resetting of the document paper M on the document tray 21 (S124).

Viewing the message displayed at the display device 41, the user corrects, for example, the warp of each sheet of the document paper M on the document tray 21, resets each sheet of the document paper M on the document tray 21, and operates the start key of the operation device 42 to input a document reading instruction. Upon receiving the document reading instruction ("Document reading" in S125), the controller 46 releases the stopping of the rotation operation of the paper feed roller 22 (S112) and sets the normal mode (S113).

Therefore, when the rear end part of the document paper M is warped upward, the alarm display is provided, and in accordance with a message of the alarm display, the user corrects the warp of each sheet of the document paper M on the document tray 21 and then operates the start key, setting the normal mode.

In the normal mode, the processing as described above and illustrated in the flowchart of FIG. 9B is performed, and the sheets of document paper M on the document tray 21 are sequentially drawn and conveyed at short paper intervals.

Moreover, the controller 46 causes a key for selecting the safe paper feed mode to be displayed together with the aforementioned alarm display on the screen of the display device 41 in S124. Upon touch operation performed on the aforementioned key by the user, an instruction for setting the safe paper feed mode through the touch panel is inputted. Upon receiving the instruction for setting the safe paper feed mode ("Safe paper feed mode" in S125), the controller 46 releases the stopping of the rotation operation of the paper feed roller 22 (S126) and sets the safe paper feed mode (S127).

In this safe paper feed mode, the controller 46 rotates the paper feed roller 22 in order to move the tip of the second sheet of the document paper M on the document tray 21 to the paper feed start position Ps and determines whether or not the detection output of the paper feed sensor 24 indicates the presence of the document paper M (S128). When the detection output of the paper feed sensor 24 indicates the absence of the document paper M ("Absent" in S128), the controller 46 stops the conveyance motor 51, the electromagnetic clutch 52, etc. to end the conveyance of the document paper M by the document conveyance device 20. Then the processing illustrated in FIG. 9C ends.

Moreover, when the detection output of the paper feed sensor 24 indicates the presence of the document paper M ("Present" in S128), the controller 46 rotates the paper feed roller 22, causing the paper feed roller 22 to draw the second sheet of the document paper M on the document tray 21, brings the tip of the document paper M to abut the registration roller 23 temporarily stopped, subsequently causing the registration roller 23 to convey the document paper M (S129). A paper feed start timing in S129 is defined as the paper feed start time point t0. Then the controller 46 starts the counting of the specified time Δta from the paper feed start time point t0 as illustrated in FIG. 10 (S130).

The controller 46 determines whether or not the detection output of the registration sensor 25 is switched from the absence to the presence of the document paper M (S131) and also determines whether or not the specified time Δta has passed (S132).

For example, when the detection output of the registration sensor 25 is switched from the absence to the presence of the document paper M ("Present" in S131) before the passage of the specified time Δta ("No in S132), the controller 46 stands by for further switching of the detection output of the registration sensor 25 from the presence to the absence of the document paper M ("Present" in S133), and upon the switching of the detection output from the presence to the absence ("Absent" in S133), at the timing at which this switching has occurred, the controller 46 causes only the rotation operation of the paper feed roller 22 to be performed until the tip of the document paper M on the document tray 21 is moved to the paper feed start position Ps, and as illustrated in FIG. 8, sets the aforementioned time point as the switching time T1 and sets the delay time point T2 at which the fixed delay time ΔT has passed since the aforementioned switching time point (S134), and determines whether or not the detection output of the paper feed sensor 24 indicates the presence of the document paper M at the delay time point T2 (S135).

When the detection output of the paper feed sensor 24 indicates the presence of the document paper M at the delay time point T2 as illustrated in FIG. 7D ("Present" in S135), the controller 46 returns to the processing in S129, causing the paper feed roller 22 and the registration roller 23 to perform the draw and the conveyance of the next sheet of the document paper M. Similarly, when the next sheet of the document paper M is set on the document tray 21, the processing in S129 to S135 is repeated, and the draw and conveyance of the next sheet of the document paper M are performed at the delay time point T2 at which the fixed delay time ΔT has passed since the switching time point t1 at which the detection output of the registration sensor 25 is switched from the presence to the absence. Thus, the sheets of the document paper M are sequentially drawn and conveyed at long paper intervals. Moreover, even when the rear end part of the last sheet of the document paper M is warped upward, the paper feed sensor 24 reliably detects whether the tip of the next sheet of the document paper M is present or absent, so that the paper feed roller 22 is not idled.

Figure 9C:
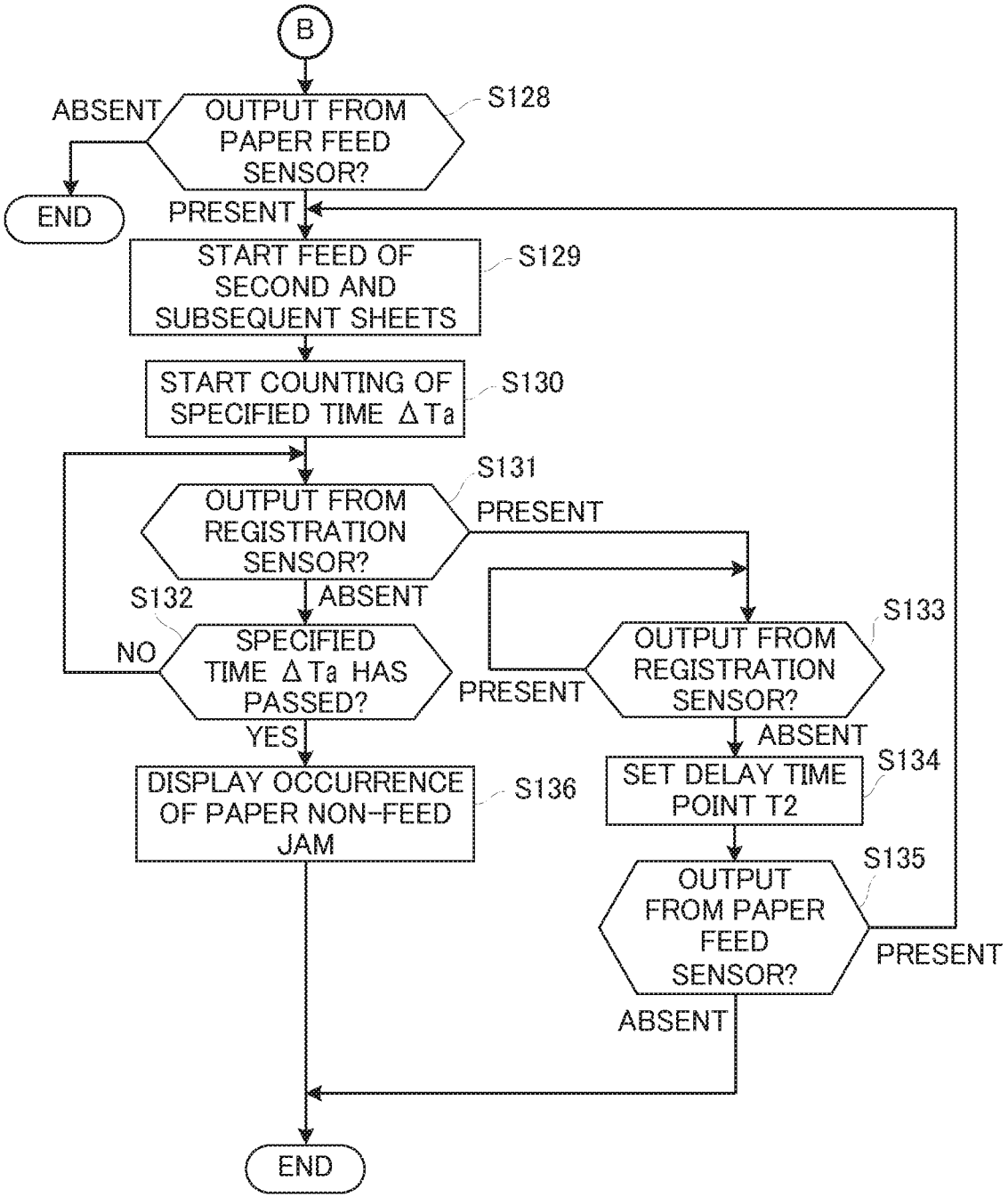
FIG. 9C is a flowchart illustrating procedures of processing performed in the safe paper feed mode, following FIG. 9A.

Moreover, when the detection output of the paper feed sensor 24 indicates the absence of the document paper M at the delay time point T2 as illustrated in FIG. 7C ("Absent" in S135), the controller 46 stops the conveyance motor 51, the electromagnetic clutch 52, etc. to end the conveyance of the document paper M by the document conveyance device 20, ending the processing illustrated in FIG. 9C.

Moreover, the controller 46 stands by for time corresponding to the delay time point T2 and judges whether the detection output of the paper feed sensor 24 indicates the presence or the absence in S135, thus avoiding the indication of the presence of the document paper M by the detection output of the paper feed sensor 24 as a result of failure of the oscillation lever 24A of the paper feed sensor 24 to completely return despite of the absence of the document paper M as illustrated in FIG. 7B.

Moreover, when the specified time Δta has passed ("Yes" in S132) without switching of the detection output of the registration sensor 25 from the absence to the presence of the document paper M ("Absent" in S131), the controller 46 assumes that paper non-feed jam has occurred, causing the display device 41 to display a message indicating that the paper non-feed jam has occurred (S136), and stops the conveyance motor 51, the electromagnetic clutch 52, etc. to end the conveyance of the document paper M by the document conveyance device 20. Then the processing illustrated in FIG. 9C ends.

In this embodiment as described above, when the tip of the oscillation lever 24A of the paper feed sensor 24 is greatly bounced upward by the rear end part of the document paper M in a state in which the rear end part of the document paper M is warped upward, the alarm display or the safe paper feed mode is set. With the alarm display, the message prompting the resetting of the document paper M on the document tray 21 is displayed at the display device 41, so that the user can view the message to correct, for example, the warp of the document paper M on the document tray 21 and reset the document paper M on the document tray 21 to continue the conveyance of the document paper M by the document conveyance device 20 and reading of an image of the document paper M by the image reading device 11. Moreover, in the safe paper feed mode, the paper interval between the sheets of the document paper M increases but even when the tip of the oscillation lever 24A of the paper feed sensor 24 is greatly bounced up by the rear end part of the document paper M warped upward, the tip of the oscillation lever 24A of the paper feed sensor 24 is oriented downward during the delay time ΔT, thus making it possible to reliably detect the presence or absence of the tip of the document paper M by the paper feed sensor 24 and draw the document paper M by the paper feed roller 22 without idling of the paper feed roller 22, which in turn makes it possible to continue the conveyance of the document paper M by the document conveyance device 20 and the reading of the image of the document paper M by the image reading device 11.

However, in each of the devices described in the Background above, the next sheet of the paper is drawn and conveyed by the paper feed roller when the next sheet of the paper has been detected by the paper feed sensor at a time point at which the passage of the rear end of the paper has been detected by the registration roller, but upon erroneous detection of the next sheet of the paper by the paper feed sensor despite of the absence of the next sheet of the paper at the paper feed start position, the paper feed roller is consequently idled. That is, the paper feed roller is idled due to the erroneous detection of the paper feed roller. Long-term or repeated idling of the paper feed roller decreases the life of the paper feed roller.

In the first sheet feeding device described in the Background above, it is possible to set the number of times of the retry of the paper feed by the paper feed roller in accordance with, for example, the state of the abrasion of the paper feed roller, but this is a method of repeating the retry of the paper feed and thus it is hard to say that the abrasion of the paper feed roller is effectively prevented.

Moreover, in the second sheet feeding device described in the Background above, when the paper arrival cannot be detected by the paper sensor within the predefined time since the start of the rotation of the paper feed roller, the retry operation of the paper feed roller is performed the predefined number of times, and as is the case with the first sheet feeding device, this is a method of repeating the retry of paper feed and it is hard to say that the abrasion of the paper feed roller is effectively prevented.

That is, the aforementioned technology of each device is a technology for preventing failure in the paper feed and is not a technology of reducing the idling of the paper feed roller due to the erroneous detection of the paper feed sensor.

On the contrary, it is possible in this embodiment to continue the paper conveyance while suppressing, at a minimum, the idling of the paper feed roller due to the erroneous detection of the next sheet of paper by the paper feed sensor.

The embodiment described above illustrates the control of the conveyance of the document paper M in the document conveyance device 20 of the image reading device 11, but this disclosure may be applied to control of conveyance of recording paper in the image forming apparatus 10.

The configuration of the embodiment and modified example above have been described with reference to FIGS. 1 to 10, but they are each just one example of this disclosure and this disclosure is not limited to the aforementioned configuration.

While the present disclosure has been described in detail with reference to the embodiments thereof, it would be apparent to those skilled in the art the various changes and modifications may be made therein within the scope defined by the appended claims.

What is claimed is:

1. A paper conveyance device comprising:

a roller sequentially drawing a plurality of sheets of paper from a paper feed start position and conveying the plurality of sheets of paper;

a paper feed sensor detecting presence or absence of the paper at the paper feed start position;

a registration sensor detecting presence or absence of the paper at a position located on a more downstream side than the paper feed start position in a paper conveyance direction; and a control device including a processor and, as a result of execution of a control program by the processor, functioning as a controller being configured to set either of a normal mode, in which a next sheet of the paper is drawn and conveyed by the roller at a switching time point at which a result of the detection by the registration roller is switched from the presence to the absence of the paper, and a safe paper feed mode, in which the draw of the paper by the roller is started at a delay time point at which preset delay time has passed since the switching time point, wherein the controller is further configured to: at a first time point at which specified time from start of the draw of the paper by the roller to arrival of the paper at the registration sensor has passed, when the result of the detection by the registration sensor is the absence of the paper and a result of the detection by the paper feed sensor is the presence of the paper, stand by for preset standby time from the first time point; and at a second time point at which the standby time has passed, when the result of the detection by the paper feed sensor is the absence of the paper, set the safe paper feed mode.

2. The paper conveyance device according to claim 1, further comprising:

a display device; and an operation device being operated by a user, wherein the controller causes the display device to display an alarm prompting selection of either of resetting of the paper at the paper feed start position and the safe paper feed mode when the result of the detection by the paper feed sensor is the absence of the paper at the second time point, and the controller sets the safe paper feed mode upon the selection of the safe paper feed mode through the operation of the operation device.

3. The paper conveyance device according to claim 1, further comprising a display device, wherein the controller causes the display device to display occurrence of paper non-feed jam when the result of the detection by the registration sensor is the absence of the paper and the result of the detection by the paper feed sensor is the absence of the paper at the first time point or when the result of the detection by the paper feed sensor is the presence of the paper at the second time point.

4. The paper conveyance device according to claim 1, wherein the paper feed sensor has: an oscillation lever being supported in a manner such as to be rotatable around an axis and being oriented downward by own weight of the oscillation lever; and a detection device detecting a state of the oscillation lever oriented downward and a state of the oscillation lever abutting the paper at the paper feed start position and being pushed upward.

5. The paper conveyance device according to claim 4, wherein the preset delay time and the preset standby time are time required for a tip of the oscillation lever of the paper feed sensor to be oriented downward from a state in which the tip of the oscillation lever is bounced upward by a rear end part of the paper as a result of a state in which the rear end part of the paper is warped upward.

6. The paper conveyance device according to claim 4, wherein the registration sensor has: an oscillation lever being supported in a manner such as to be rotatable around an axis and being oriented upward by own weight of the oscillation lever; and a detection device detecting a state of the oscillation lever being oriented upward and a state of the oscillation lever abutting the paper and pushed down.

7. An image reading device, comprising:

the paper conveyance device according to claim 1; and a reading device reading an image recorded on the paper conveyed by the paper conveyance device.

8. An image forming apparatus, comprising:

the image reading device according to claim 7; and an image forming device recording, on recording paper, the image read by the image reading device.

* * * * *